US009724803B2

(12) United States Patent
Wang et al.

(10) Patent No.: US 9,724,803 B2
(45) Date of Patent: Aug. 8, 2017

(54) NOZZLE FOR STRESS-FREE POLISHING METAL LAYERS ON SEMICONDUCTOR WAFERS

(75) Inventors: Jian Wang, Shanghai (CN); Yinuo Jin, Shanghai (CN); Hui Wang, Shanghai (CN)

(73) Assignee: ACM Research (Shanghai) Inc., Shanghai (CN)

( * ) Notice: Subject to any disclaimer, the term of this patent is extended or adjusted under 35 U.S.C. 154(b) by 256 days.

(21) Appl. No.: 14/389,540

(22) PCT Filed: Mar. 30, 2012

(86) PCT No.: PCT/CN2012/073300
§ 371 (c)(1),
(2), (4) Date: Sep. 30, 2014

(87) PCT Pub. No.: WO2013/143115
PCT Pub. Date: Oct. 3, 2013

(65) Prior Publication Data
US 2015/0072599 A1 Mar. 12, 2015

(51) Int. Cl.
*B24C 5/04* (2006.01)
*C25F 7/00* (2006.01)
*C25F 3/30* (2006.01)

(52) U.S. Cl.
CPC ..... *B24C 5/04* (2013.01); *C25F 3/30* (2013.01); *C25F 7/00* (2013.01)

(58) Field of Classification Search
CPC ..... B24C 5/04; C25F 3/30; C25F 7/00
See application file for complete search history.

(56) References Cited

U.S. PATENT DOCUMENTS 5,157,876 A 10/1992 Medellin
6,395,152 B1 * 5/2002 Wang ..... C25F 3/22 204/224 M (Continued)

FOREIGN PATENT DOCUMENTS

CN 1767155 A 5/2006
JP H06285720 A 10/1994

(Continued)

OTHER PUBLICATIONS

International Search Report issued in PCT/CN2012/073300 mailed on Jan. 3, 2013 (2 pages).

(Continued)

*Primary Examiner* — Marc Carlson
(74) *Attorney, Agent, or Firm* — Osha Liang LLP

(57) ABSTRACT

A nozzle for charging and ejecting electrolyte in SFP process is disclosed. The nozzle includes an insulated foundation defining a through-hole, a conductive body as negative electrode connecting with a power source for charging the electrolyte and an insulated nozzle head. The conductive body has a fixing portion located on the insulated foundation. The fixing portion forms a receiving portion inserted into the through-hole and defining a receiving hole passing therethrough. The insulated nozzle head has a cover assembled with the insulated foundation above the conductive body and a tube extending through the cover and defining a main fluid path through where the charged electrolyte is ejected for polishing. The tube is inserted in the receiving hole and stretches out of the receiving hole of the conductive body forming an auxiliary fluid path between an inner circumferential surface of the receiving portion and an outer circumferential surface of the tube.

20 Claims, 7 Drawing Sheets

(56) References Cited

U.S. PATENT DOCUMENTS

| | | | | |
|---|---|---|---|---|
| 6,527,920 | B1 * | 3/2003 | Mayer | C25D 21/12 204/237 |
| 7,837,850 | B2 * | 11/2010 | Guo | C25D 17/00 204/194 |

FOREIGN PATENT DOCUMENTS

| | | | | |
|---|---|---|---|---|
| JP | 2002110592 | A | 4/2002 | |
| JP | 2003255479 | A | 9/2003 | |
| KR | 10-1105699 | B1 | 1/2012 | |
| SU | FR 2659667 | A1 * | 9/1991 | C25F 7/00 |
| WO | 2006/110864 | A2 | 10/2006 | |
| WO | WO 2006110864 | A2 * | 10/2006 | B23H 5/08 |

OTHER PUBLICATIONS

Office Action issued Apr. 1, 2016 in corresponding Chinese application No. 201280071560.5 (English translation of Search Report only) (7 pages).

Office Action issued Mar. 8, 2016 in corresponding Japanese application No. 2015-502044 (2 pages).

* cited by examiner

NOZZLE FOR STRESS-FREE POLISHING METAL LAYERS ON SEMICONDUCTOR WAFERS

FIELD OF THE INVENTION

The present invention generally relates to a nozzle, and more particularly relates to a nozzle used for stress-free polishing metal layers on semiconductor wafers.

BACKGROUND

Semiconductor devices are widely applied in electronic industry. The semiconductor devices are manufactured or fabricated on semiconductor material usually called semiconductor wafers. In order to form electronic circuitry of the semiconductor devices, the semiconductor wafers undergo multiple masking, etching, copper planting and polishing processes, and so on.

Traditionally, in the polishing process, chemical mechanical polishing (CMP) technology is used to remove unnecessary copper layers on the semiconductor wafers. A CMP apparatus includes a rotatable table, a polishing pad disposed on the table, a wafer carrier head for gripping the wafer which needs to be polished, and a slurry feeder providing slurry between the wafer and the polishing pad. A downward press force is acted on the wafer carrier head to press the wafer against the polishing pad, which enforces the wafer to rotate relatively to the polishing pad. Then, the wafer is polished.

However, in order to continually shrink the feature dimension of the semiconductor devices, low K dielectric material or air gap structure is applied in the semiconductor devices. Nevertheless both of the low K dielectric material and the air gap structure have a weak mechanical property, so the downward press force acted on the wafer carrier head in the CMP process will damage the low K dielectric material and further damage the semiconductor devices.

For solving the above problem, stress-free polishing (SFP) technology is provided and suitable for manufacturing tiny semiconductor devices. The stress-free polishing technology is based on the electrochemical polishing mechanism to remove the unnecessary copper layers without mechanical force, avoiding damaging low K dielectric layers on the semiconductor wafers. The quality of the semiconductor devices is improved. A SFP apparatus includes a mechanical motion and control system, an electrolyte deliver system, an electricity supply and control system. In the SFP process, chemical liquid is used as the electrolyte and ejected on a surface of the copper layer which needs to be polished by a nozzle.

However, a common nozzle has a serious shortcoming When the nozzle also used as an electrode is used for polishing the wafer, bubbles are easily generated in the nozzle and ejected on the wafer together with the electrolyte, which results in the poor roughness and defects on the surface of the wafer.

Referring to FIG. 6, FIG. 6 is a partial enlarged view of the surface of the wafer after the wafer is polished by using the nozzle. As can be seen from the drawing, there are two concave holes on the surface of the wafer. The two concave holes are generated by the bubbles. Referring to FIG. 7, FIG. 7 is a profile diagram of the surface of the wafer measured by profilometry. The diagram shows a greater wave crest and a greater wave trough thereon. The greater wave crest represents an area covered by the bubbles on the wafer. The greater wave trough represents an area of the concave hole.

During the polishing process, the bubbles blocks the electrolyte directly contacting with the surface of the wafer, which causes the area covered by the bubbles cannot be polished. At the same time, the charge at the area covered by the bubbles isn't consumed and shifts to an adjacent area, causing the adjacent area to be polished overly to form the concave hole. The concave hole brings a detrimental impact on the property of the semiconductor device.

Otherwise, the electrolyte distribution range and shape on the surface of the wafer cannot be controlled well, which affects the removal rate and removal uniformity of the copper layer, and also doesn't satisfy different requirements of the polishing process.

SUMMARY

Accordingly, an object of the present invention is to provide a nozzle used for stress-free polishing metal layers on semiconductor wafers. The nozzle for charging and ejecting electrolyte in the polishing process includes an insulated foundation, a conductive body and an insulated nozzle head. The insulated foundation defines a through-hole passing therethrough. The conductive body as negative electrode connecting with a power source for charging the electrolyte has a fixing portion located on the insulated foundation. The fixing portion protrudes to form a receiving portion inserted into the through-hole of the insulated foundation. The receiving portion defines a receiving hole passing therethrough and the fixing portion. The insulated nozzle head has a cover stably assembled with the insulated foundation above the conductive body and a tube extending through the cover and defining a main fluid path through where the charged electrolyte is ejected out for polishing The tube is inserted in the receiving hole and stretches out of the receiving hole of the conductive body. An auxiliary fluid path is formed between an inner circumferential surface of the receiving portion and an outer circumferential surface of the tube.

As described above, in the present invention, there are two fluid paths and the electrolyte can be separated into two streams by the tube. One stream of the electrolyte is transported through the main fluid path of the insulated nozzle head and is ejected on the surface of the wafer via an ejecting port of the tube to react with the metal layer and then the metal layer is polished and removed without mechanical force. The other stream of the electrolyte is transported through the auxiliary fluid path and is recycled without being ejected on the surface of the wafer. Since the tube stretches out of the receiving hole of the conductive body, the tube can prevent bubbles generated and attached on the electrode from entering the main fluid path. Hence, the bubbles are just transported together with the other stream of the electrolyte through the auxiliary fluid path and turned back by the cover of the insulated nozzle head, which prevents the bubbles from being ejected on the surface of the wafer. The polished surface roughness of the wafer is conspicuously improved. Meanwhile, because the ejecting port of the tube can be designed into different shapes such as circle or triangle or square or hexagon or octagon to satisfy the different requirements of the polishing process, the electrolyte distribution range and shape on the surface of the wafer are controlled well, which improves the removal rate and the removal uniformity of the metal layer on the semiconductor wafer.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF EMBODIMENTS

Figure 1:
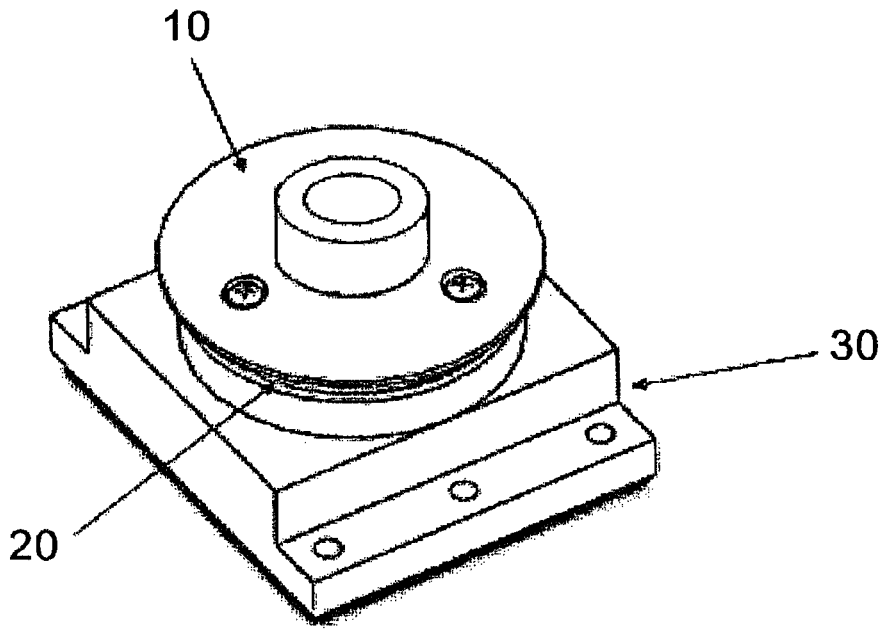
FIG. 1 is a perspective view of a nozzle in accordance with the present invention.
Figure 2:
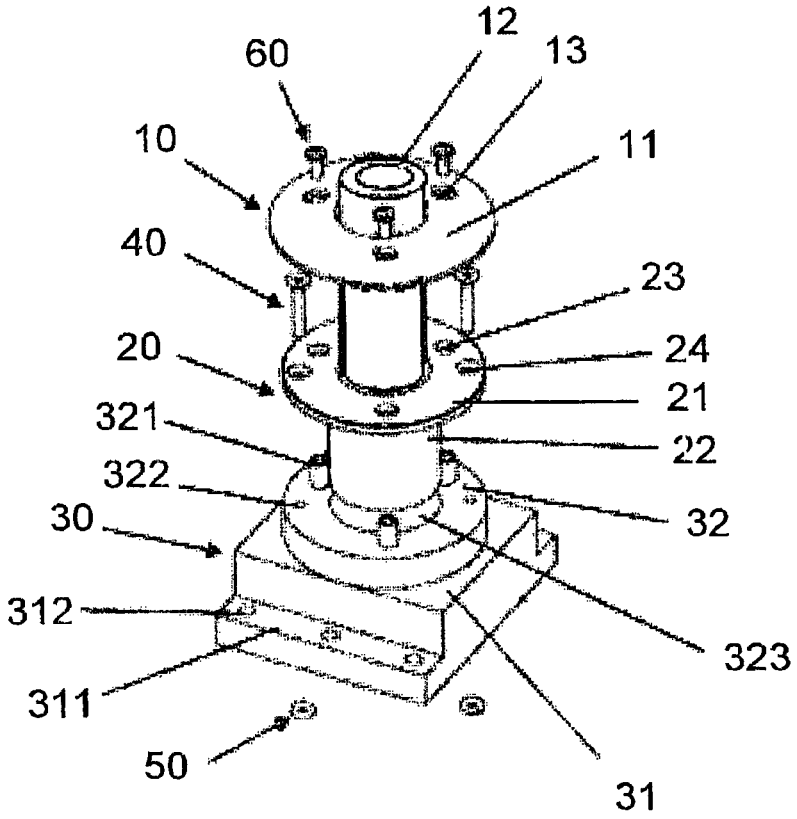
FIG. 2 is an exploded view of the nozzle.
Figure 3:
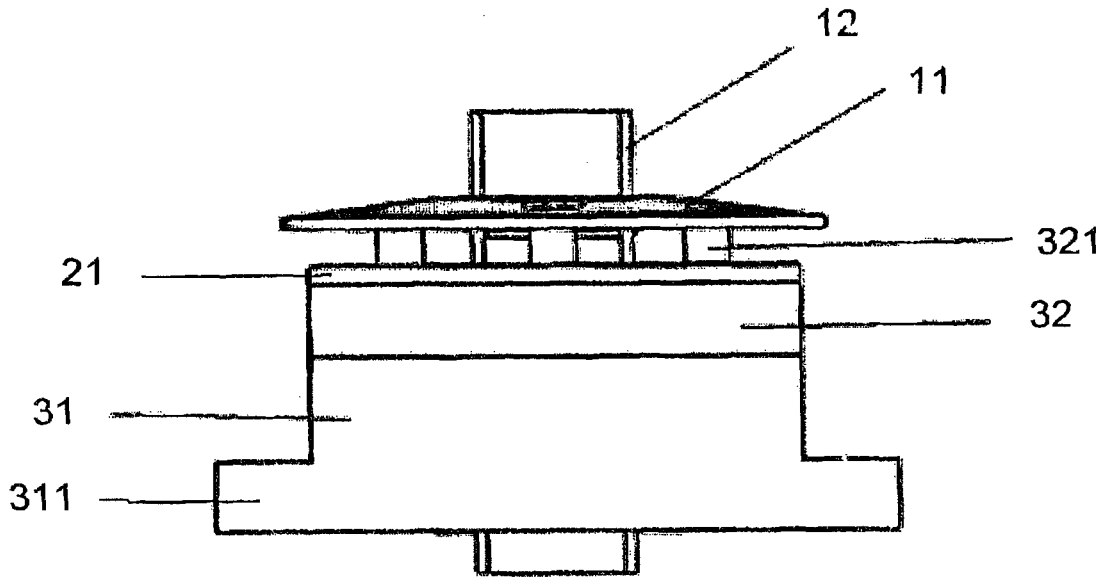
FIG. 3 is a front view of the nozzle.
Figure 4:
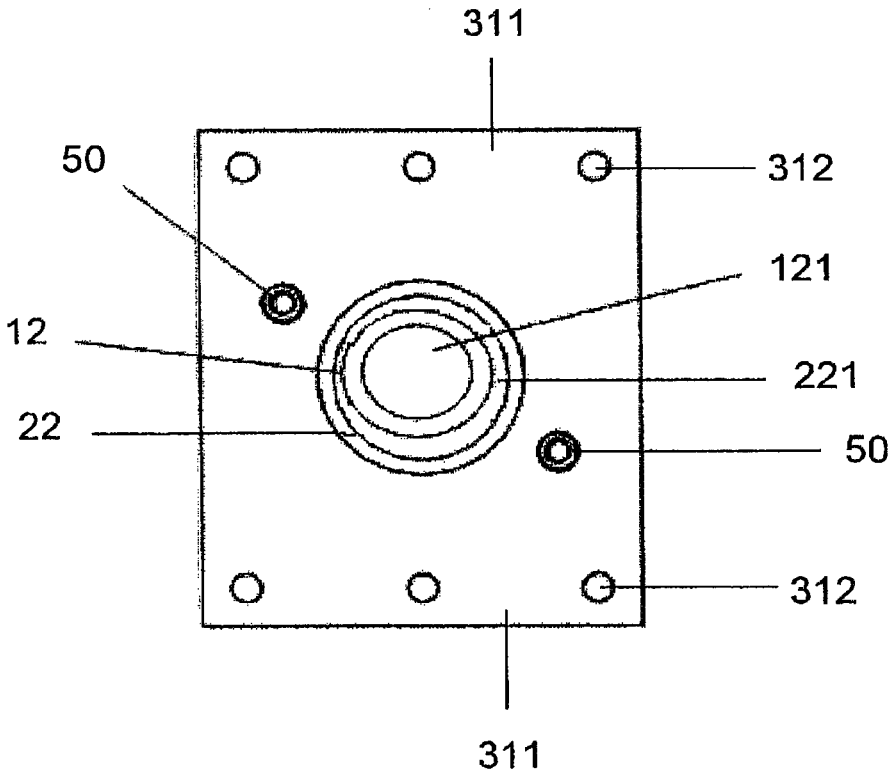
FIG. 4 is a bottom view of the nozzle.
Figure 5:
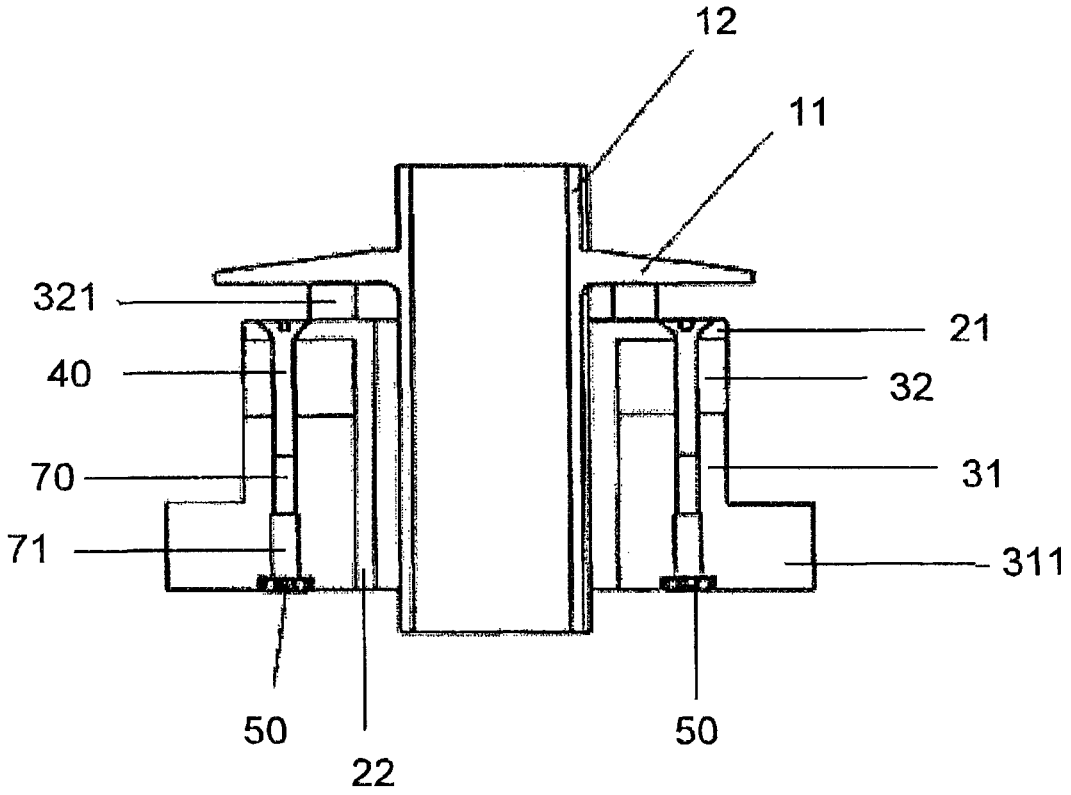
FIG. 5 is a cross-sectional view of the nozzle.
Figure 6:
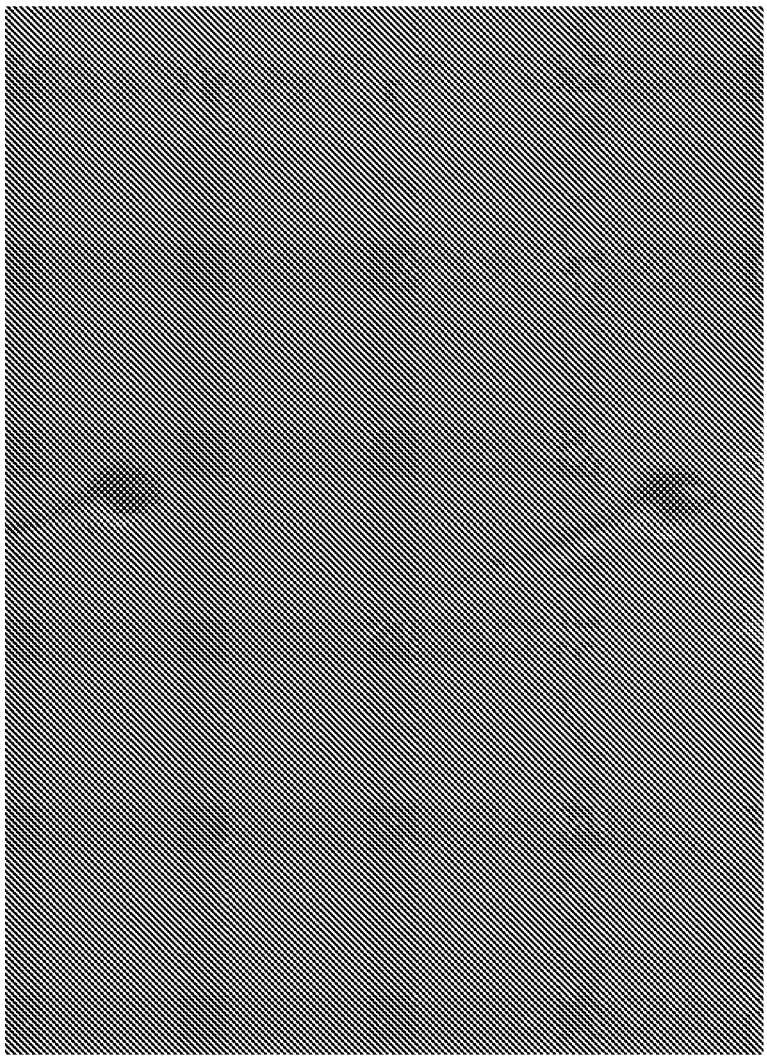
FIG. 6 is a partial enlarged view of a surface of a wafer after the wafer is polished by using a common nozzle.
Figure 7:
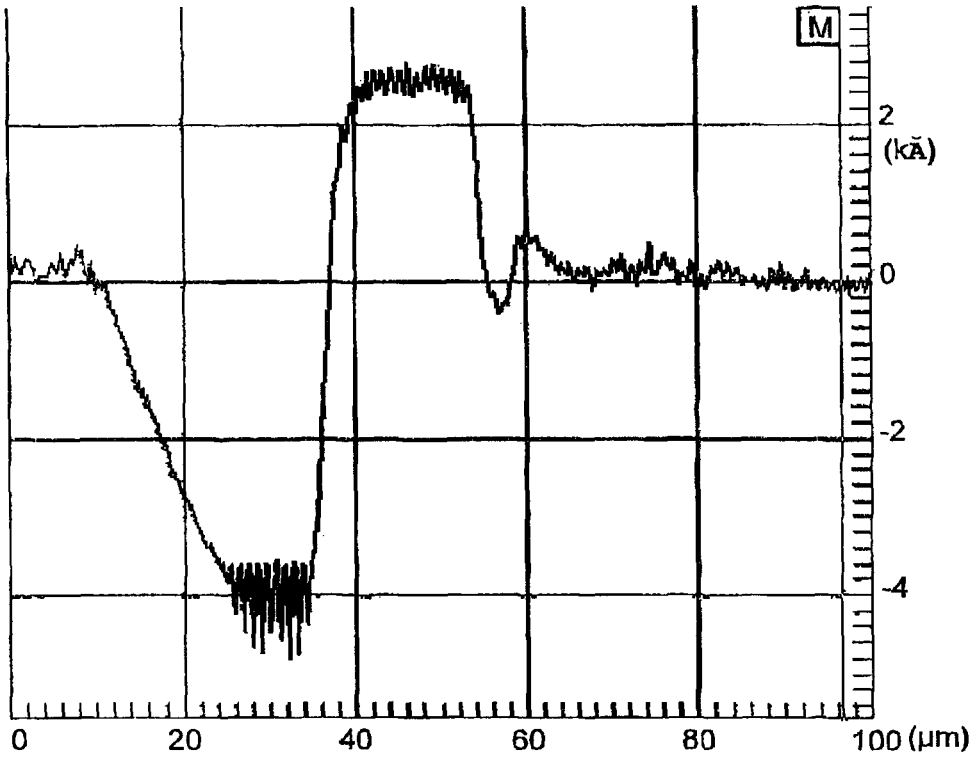
FIG. 7 is a profile diagram of FIG. 6 measured by profilometry.

Referring to FIG. 1, a nozzle used for stress-free polishing metal layers on semiconductor wafers in the manufacture process of semiconductor devices in accordance with the present invention is illustrated that includes an insulated substantially mushroom nozzle head 10, a conductive body 20, and an insulated foundation 30 disposed on a bottom plate of a polishing process chamber (not shown). The insulated foundation 30 supports the insulated nozzle head 10 and the conductive body 20 disposed between the insulated foundation 30 and the insulated nozzle head 10. For better understanding the present invention, the nozzle will be described in detail hereinafter.

Referring to FIGS. 1 to 4, the insulated nozzle head 10 is made of such as Propene Polymer (PP), Polyethylene (PE), Polyethylene Terephthalate (PET). The insulated nozzle head 10 has a disk-shaped cover 11 and a tube 12 extending vertically through the center of the cover 11 and the entire of the nozzle. The top port of the tube 12 is defined as an ejecting port from where electrolyte is ejected on a surface of the wafer. The ejecting port of the tube 12 is circular. Based on different requirements of the polishing process, the shape of the ejecting port can be changed and designed not only into circle, but also triangle or square or hexagon or octagon and so on. The tube 12 defines a main fluid path 121 passing therethrough. Three first screw holes 13 are defined on the cover 11.

The conductive body 20 is made of good conductive material and can resist erosion of the electrolyte and cannot react with the electrolyte, such as stainless steel or aluminum alloy and so on. The conductive body 20 has a fixing portion 21. The center of the fixing portion 21 protrudes downward to form a cylinder receiving portion 22 defining a receiving hole 221 passing therethrough and the corresponding fixing portion 21. Three fixing holes 23 and two second screw holes 24 are respectively symmetrically defined on the fixing portion 21.

The insulated foundation 30 has a base portion 31. Opposite sidewalls of the base portion 31 respectively protrude outwardly to form two locating portions 311. Three third screw holes 312 are defined on each of the locating portions 311. The center of the base portion 31 protrudes upwardly to form a cylinder-shaped holding portion 32. Three hollow locking portions 321 are formed on a top surface of the holding portion 32. Two connecting holes 322 are defined on the holding portion 32 and pass through the holding portion 32 and the base portion 31 symmetrically. The center of the holding portion 32 defines a through-hole 323 passing therethrough and the base portion 31 and surrounded by the three hollow locking portions 321 and the two connecting holes 322.

Please refer to FIGS. 1 to 5. In assembly, the receiving portion 22 of the conductive body 20 is inserted into the through-hole 323 of the holding portion 32 of the insulated foundation 30. Meanwhile the fixing portion 21 is disposed on the top surface of the holding portion 32. The hollow locking portions 321 respectively pass through the fixing holes 23 to lock the conductive body 20 with the insulated foundation 30. The tube 12 of the insulated nozzle head 10 is inserted in the receiving hole 221 of the conductive body 20 and stretches out of the receiving hole 221. An auxiliary fluid path is formed between an inner circumferential surface of the receiving portion 22 and an outer circumferential surface of the tube 12. Three insulated screws 60 are provided and inserted in the first screw holes 13 of the insulated nozzle head 10 and further inserted into the hollow locking portions 321 respectively to lock the insulated nozzle head 10 with the insulated foundation 30 stably. Two conductive screws 40 are provided and inserted in the second screw holes 24 and further inserted in the connecting holes 322 of the insulated foundation 30. Two conductive spring pins 70 are provided and respectively inserted in the connecting holes 322 from the bottom of the connecting holes 322. Two plastic protecting sleeves 71 are provided and inserted inside the connecting holes 322. The protecting sleeves 71 surround the spring pins 70 to protect the spring pins 70. A tip end of the spring pin 70 connects with a bottom end of the conductive screw 40, and a bottom end of the spring pin 70 is inserted in the bottom plate and connects with an external electric cable to provide electric current to the conductive body 20. Two insulated O-shaped sealing rings 50 are provided and disposed inside the connecting holes 322 between the insulated foundation 30 and the bottom plate to prevent the electrolyte from infiltrating into the connecting holes 322 and eroding the spring pins 70 and the electric cable. The insulated foundation 30 is fixed on the bottom plate by six screws inserted in the third screw holes 312. The six screws can resist erosion of the electrolyte.

In the stress-free polishing process, the metal layer, preferably copper or copper alloy layer to be polished on the semiconductor wafer is as positive electrode and disposed above the nozzle. The conductive body 20 of the nozzle is as negative electrode. An electric current is provided to the conductive body 20 through the electric cable and the spring pins 70 and the conductive screws 40. Chemical liquid used as the electrolyte is supplied to the nozzle and charged by the conductive body 20. The charged electrolyte is separated into two streams by the tube 12. One stream of the electrolyte is transported through the main fluid path 121 of the insulated nozzle head 10 and is ejected on the surface of the wafer via the ejecting port of the tube 12 to react with the metal layer and then the metal layer is polished and removed without mechanical force. The other stream of the electrolyte is transported through the auxiliary fluid path and is recycled without being ejected on the surface of the wafer.

Generally, in the polishing process, bubbles are easily generated and attached on the electrode. In the present invention, the tube 12 stretches out of the receiving hole 221 of the conductive body 20 used as the negative electrode, so the tube 12 can prevent the bubbles from entering the main fluid path 121. So the bubbles are just transported together with the other stream of the electrolyte through the auxiliary fluid path and turned back by the cover 11 of the insulated nozzle head 10, which prevents the bubbles from being ejected on the surface of the wafer. Therefore, the polished surface roughness of the wafer is conspicuously improved. Meanwhile, because the ejecting port of the tube 12 can be designed into different shapes such as circle or triangle or square or hexagon or octagon to satisfy the different requirements of the polishing process, the electrolyte distribution range and shape on the surface of the wafer are controlled well, which improves the removal rate and the removal uniformity of the metal layer on the semiconductor wafer.

The foregoing description of the present invention has been presented for purposes of illustration and description. It is not intended to be exhaustive or to limit the invention to the precise form disclosed, and obviously many modifications and variations are possible in light of the above teaching Such modifications and variations that may be apparent to those skilled in the art are intended to be included within the scope of this invention as defined by the accompanying claims.

What is claimed is:

1. A nozzle for charging and ejecting electrolyte in stress-free polishing process, comprising:

an insulated foundation, defining a through-hole passing therethrough;

a conductive body as negative electrode connecting with a power source for charging the electrolyte, the conductive body having a fixing portion located on the insulated foundation, the fixing portion protruding to form a receiving portion inserted into the through-hole of the insulated foundation, the receiving portion defining a receiving hole passing therethrough and the fixing portion; and an insulated nozzle head having a cover stably assembled with the insulated foundation above the conductive body, and a tube extending through the cover and defining a main fluid path through where the charged electrolyte is ejected out for polishing, the tube inserted in the receiving hole and stretching out of the receiving hole of the conductive body, an auxiliary fluid path formed between an inner circumferential surface of the receiving portion and an outer circumferential surface of the tube;

wherein the electrolyte is separated into two streams by the tube, one stream of the electrolyte is charged by the conductive body, transported through the main fluid path of the insulated nozzle head and ejected out for polishing, the other stream of the electrolyte is charged by the conductive body, transported through the auxiliary fluid path and recycled without being ejected;

wherein the charged electrolyte in the main fluid path and in the auxiliary fluid path are the same.

2. The nozzle as claimed in claim 1, wherein the insulated foundation defines at least one connecting hole passing therethrough, the fixing portion of the conductive body defines at least one second screw hole;

at least one conductive screw is inserted in the second screw hole of the conductive body and further inserted in the connecting hole of the insulated foundation;

at least one conductive spring pin is inserted into the connecting hole, one end of the spring pin connects with the conductive screw, the other end of the spring pin connects with the power source to provide electric current to the conductive body for charging the electrolyte.

3. The nozzle as claimed in claim 2, further comprising at least one insulated sealing ring disposed inside the connecting hole of the insulated foundation to prevent the electrolyte from infiltrating into the connecting hole and eroding the spring pin and the power source.

4. The nozzle as claimed in claim 3, further comprising at least one plastic protecting sleeve inserted inside the connecting hole of the insulated foundation and surrounding the spring pin.

5. The nozzle as claimed in claim 2, wherein the insulated foundation has a base portion, the center of the base portion protrudes to form a holding portion, the through-hole and the connecting hole are respectively defined on the holding portion and pass through the entire of the insulated foundation.

6. The nozzle as claimed in claim 5, wherein the holding portion defines hollow locking portions around the through-hole, the fixing portion of the conductive body defines fixing holes passing therethrough, the hollow locking portions are received in the fixing holes and pass through the fixing holes.

7. The nozzle as claimed in claim 6, wherein the cover of the insulated nozzle head defines first screw holes thereon, insulated screws are inserted in the first screw holes and further inserted in the hollow locking portions.

8. The nozzle as claimed in claim 1, wherein the tube defines a top port thereof as an ejecting port through where the electrolyte is ejected on a wafer, the shape of the ejecting port is one of the following: circular, triangular, square, hexagonal or octagonal.

9. The nozzle as claimed in claim 1, wherein the insulated nozzle head is made of Propene Polymer (PP) or Polyethylene (PE) or Polyethylene Terephthalate (PET).

10. The nozzle as claimed in claim 1, wherein the conductive body is made of a material that is conductive, erosion resistant and not reactive with the electrolyte material.

11. The nozzle as claimed in claim 10, wherein the material is stainless steel or aluminum alloy.

12. A nozzle for charging and ejecting electrolyte in stress-free polishing process, comprising:

an insulated foundation, defining a through-hole passing therethrough;

a conductive body as negative electrode connecting with a power source for charging the electrolyte, the conductive body having a fixing portion located on the insulated foundation, the fixing portion protruding to form a receiving portion inserted into the through-hole of the insulated foundation, the receiving portion defining a receiving hole passing therethrough and the fixing portion;

an insulated nozzle head having a cover stably assembled with the insulated foundation above the conductive body, and a tube extending through the cover and defining a main fluid path through where the charged electrolyte is ejected out for polishing, the tube inserted in the receiving hole and stretching out of the receiving hole of the conductive body, an auxiliary fluid path formed between an inner circumferential surface of the receiving portion and an outer circumferential surface of the tube;

wherein the insulated foundation defines at least one connecting hole passing therethrough, the fixing portion of the conductive body defines at least one second screw hole;

at least one conductive screw is inserted in the second screw hole of the conductive body and further inserted in the connecting hole of the insulated foundation; and at least one conductive spring pin is inserted into the connecting hole, one end of the spring pin connects with the conductive screw, the other end of the spring pin connects with the power source to provide electric current to the conductive body for charging the electrolyte.

13. The nozzle as claimed in claim 12, further comprising at least one insulated sealing ring disposed inside the connecting hole of the insulated foundation to prevent the electrolyte from infiltrating into the connecting hole and eroding the spring pin and the power source.

14. The nozzle as claimed in claim 13, further comprising at least one plastic protecting sleeve inserted inside the connecting hole of the insulated foundation and surrounding the spring pin.

15. The nozzle as claimed in claim 12, wherein the insulated foundation has a base portion, the center of the base portion protrudes to form a holding portion, the through-hole and the connecting hole are respectively defined on the holding portion and pass through the entire of the insulated foundation.

16. The nozzle as claimed in claim 15, wherein the holding portion defines hollow locking portions around the through-hole, the fixing portion of the conductive body defines fixing holes passing therethrough, the hollow locking portions are received in the fixing holes and pass through the fixing holes.

17. The nozzle as claimed in claim 16, wherein the cover of the insulated nozzle head defines first screw holes thereon, insulated screws are inserted in the first screw holes and further inserted in the hollow locking portions.

18. The nozzle as claimed in claim 12, wherein the tube defines a top port thereof as an ejecting port through where the electrolyte is ejected on a wafer, the shape of the ejecting port is one of the following: circular, triangular, square, hexagonal or octagonal.

19. The nozzle as claimed in claim 12, wherein the insulated nozzle head is made of Propene Polymer (PP) or Polyethylene (PE) or Polyethylene Terephthalate (PET).

20. The nozzle as claimed in claim 12, wherein the conductive body is made of a material that is conductive, erosion resistant and not reactive with the electrolyte material, wherein the material is stainless steel or aluminum alloy.

* * * * *